United States Patent [19]

Blaak

[11] Patent Number: 4,753,163

[45] Date of Patent: Jun. 28, 1988

[54] STENCIL SQUEEGEE DEVICE

[75] Inventor: Cornelis Blaak, KD Boxmeer, Netherlands

[73] Assignee: Stork Brabanot B.V., Netherlands

[21] Appl. No.: 501,967

[22] Filed: Jun. 10, 1983

Related U.S. Application Data

[63] Continuation of Ser. No. 299,550, Sep. 4, 1981, abandoned.

[30] Foreign Application Priority Data

Sep. 8, 1980 [NL] Netherlands ..... 8005058

[51] Int. Cl.[4] ..... B41L 13/06; B41F 31/04

[52] U.S. Cl. ..... 101/120; 101/364

[58] Field of Search ..... 101/120, 364

[56] References Cited

U.S. PATENT DOCUMENTS

| | | | |
|---|---|---|---|
| 2,276,181 | 3/1942 | Foster | 101/115 |
| 2,333,382 | 11/1943 | Kent | 101/115 |
| 2,665,634 | 1/1954 | Schwartz | 101/120 |
| 2,928,340 | 3/1960 | Stein | 101/120 |
| 2,971,458 | 2/1961 | Kumins | 101/170 |
| 3,084,661 | 4/1963 | Roberts | 101/129 |
| 3,212,916 | 10/1965 | Metcalfe | 118/429 |
| 3,218,193 | 11/1965 | Isaacson | 118/429 |
| 3,400,658 | 9/1968 | Gagliardi | 101/170 |
| 4,275,656 | 6/1981 | Choma | 101/211 |
| 4,299,164 | 11/1981 | Jonkers | 101/119 |

FOREIGN PATENT DOCUMENTS

| | | | |
|---|---|---|---|
| 2302084 | 7/1974 | Fed. Rep. of Germany | 101/120 |
| 2407279 | 8/1974 | Fed. Rep. of Germany | 101/120 |
| 2540288 | 3/1976 | Fed. Rep. of Germany | 101/120 |
| 2638344 | 7/1977 | Fed. Rep. of Germany | 101/120 |
| 2709194 | 9/1978 | Fed. Rep. of Germany | 101/120 |
| 2523062 | 6/1979 | Fed. Rep. of Germany | 101/129 |
| 212810 | 3/1924 | United Kingdom | 101/120 |
| 1285649 | 8/1972 | United Kingdom | 101/120 |

*Primary Examiner*—Clyde I. Coughenour

*Attorney, Agent, or Firm*—Lucas & Just

[57] ABSTRACT

A squeegee device destined to be used in a movable stencil, comprises a support structure for a squeegee element which, in operation, is held slightly curved under some pressure in contact with the stencil, a closure strip being mounted upstream of the squeegee element and also being in contact with the stencil, so forming an adjustable gap being sealed at both ends, means being provided for the supply of pressurized viscous substance to said gap.

3 Claims, 4 Drawing Sheets

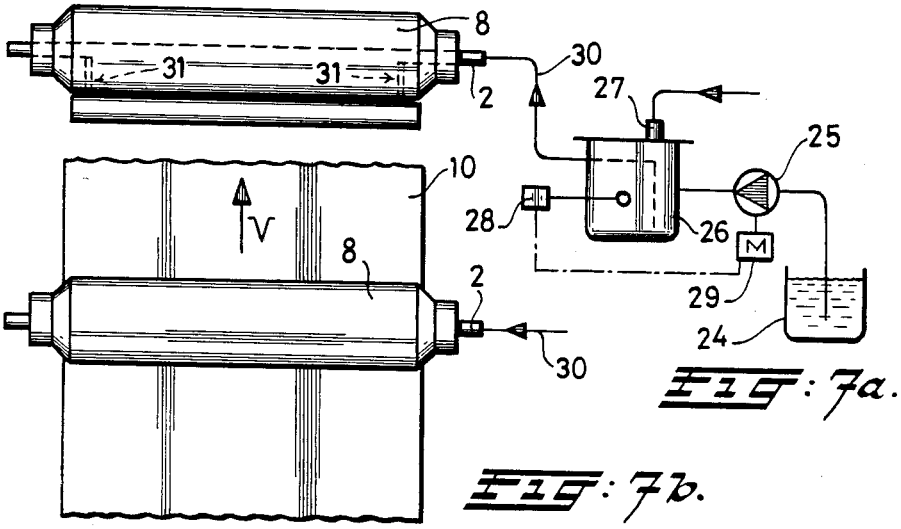
Fig: 7a.
Fig: 7b.
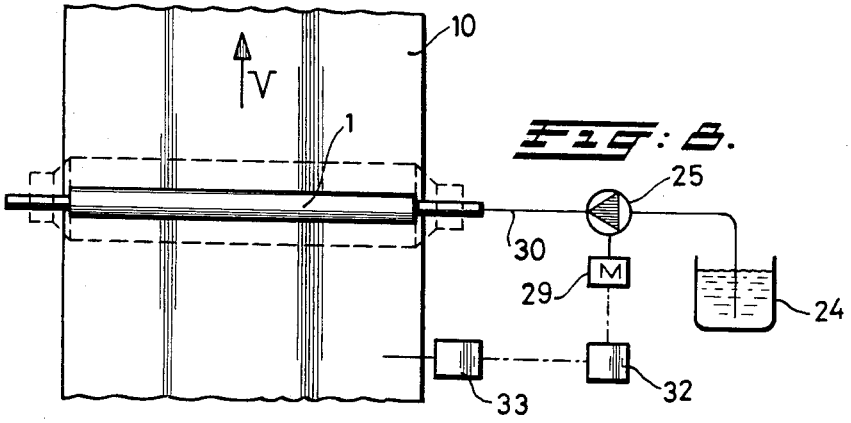
Fig: 8.
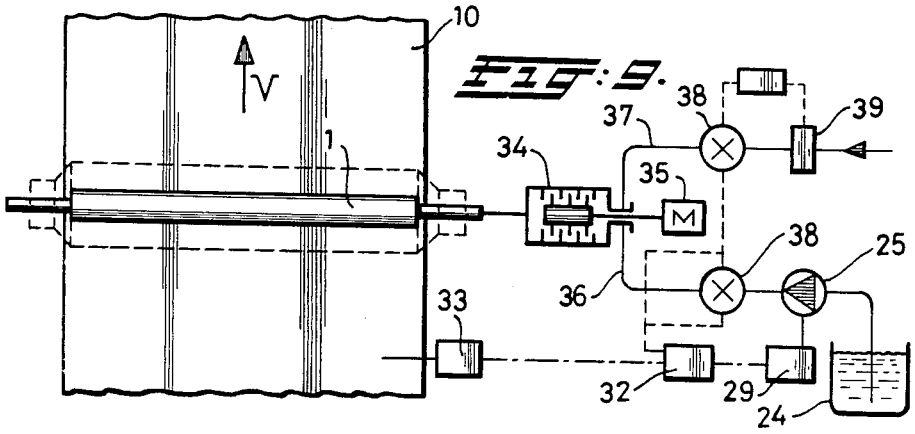
Fig: 9.

STENCIL SQUEEGEE DEVICE

This is a continuation of application Ser. No. 299,550 filed Sept. 4, 1981, now abandoned.

BACKGROUND OF THE INVENTION

1. Field of the Invention

The present invention relates to a squeegee device for pressing a viscous substance through the perforations in a movable stencil on to an advancing substrate, the device being provided with a support structure for a squeegee element, a supply for the substrate, and a biasing member whereby the squeegee element is held in contact with the stencil.

2. Discussion of the Prior Art

A squeegee device of this kind has been used in the art and is known from European Patent Application Publication No. 0,011,314, see FIGS. 10 and 11. The viscous substance to be used with this device may consist of a printing paste or thickened liquid (ink). In the known device, the squeegee element includes an acute angle with the stencil, such angle mostly being the main factor determining the ink application. In the known device, some attempt is made to render the adjustment of the angle between the squeegee element and the stencil independent of the force with which the squeegee element is held in contact with the stencil. This force particularly influences the so-called penetration, this being important particularly in the printing of fabrics. In the above-mentioned known device, a quantity of substance is present in the wedge angle between the squeegee element and the stencil. A dynamic pressure occurs in this substance or so-called ink roll and is the main cause for the substance being pressed through the stencil perforations. The substance is usually supplied via a metering pipe disposed in the support structure, the substance flowing from said pipe in an open system toward the wedge-shaped space with possible deviations in uniformity of the substance applied, particularly if the squeegee element is very long.

SUMMARY OF THE INVENTION

It is a primary object of the present invention to provide a squeegee device whereby the application of the substance to the substrate can be controlled as required within close limits without influencing the degree of penetration, another object being to obtain maximum uniformity of the substance applied to the substrate, both in the direction of the width and in the direction of the length of the substrate.

In the squeegee device according to the invention, these objects are realized by the use of a closure strip borne by the support structure and having its front edge also held in contact with the stencil in a zone which, as considered in the direction of advance, is situated some distance upstream of the squeegee element so that a passage gap is formed between the strip and those edges of the squeegee element which are in contact with the stencil, means also being provided for the pressurised supply of the viscous substance and for laterally sealing off the ends of the gap.

As a result of these features a specific static pressure of the substance is created in the space between the squeegee element and the closure strip. This pressure will urge the strip against the stencil with a force proportional to this pressure. As a result a good seal is obtained along the one side of the gap. The same static pressure and also some dynamic pressure is exerted on the squeegee element in a direction away from the stencil. This force can be accurately controlled by means of the biasing member. In this way great freedom is obtained in respect of controlling the application of the substance, particularly in the case of a foam material.

In a favorable embodiment of the squeegee device according to the present invention, the closure strip is mounted displaceably in the support structure so that the width of the gap is adjustable. By increasing this width it is possible to obtain better utilization of the absorptive power of the substrate. The optimum relationship between the amount of substance and the "definition" (i.e. the sharpness (clearness) of the printed design) are also governed by the gap width.

According to another embodiment of the present invention, the squeegee element consists of a prismatic plastic bar, preferably of polyethylene, which, on the one hand, is borne by an L-shaped gusset and which, on the other hand, is subject to the direct action of the biasing member. This bar, which offers little resistance to the stencil traveling therealong, takes over the task of the conventional doctor so that the squeegee device can be adapted to the substance being used by means of a predetermined cross-sectional shape.

According to still another embodiment of the present invention, the closure strip consists of spring strip steel and said strip rests on a metal part of the supporting structure, which part extends close to the front edge of the strip. Alternatively, the strip may be made from a plastic, since the static pressure of the substrate in the gap is largely absorbed by the metal part of the support structure. It is also possible to use a plastic sheet of little rigidity without the risk of any bulging under the influence of the static pressure.

The present invention also related to a method of applying a viscous substance to an advancing substrate by means of a stencil, using a squeegee device as described hereinbefore. In this method at least one pump is used to supply the substance ready for use, the output of the pump or pumps being kept in direct proportion to the speed of advance of the substrate while the requisite quantity of the substance applied is determined by controlling the force of the biasing member and by adjusting the width of the passage gap. Preferably, the drive for the viscous substance feed pump or pumps is coupled to the substrate advancing means. It is then possible to keep the supply of substance per unit area of the substrate constant irrespective of the printing speed and the properties of the substrate.

According to an embodiment of this method, the viscous substance is supplied in a foamed condition from a mixer connected both to a substance supply pump and to a metered gas supply. This latter is particularly important when a foam material has to be applied, the quality of which rapidly declines after it has been prepared. Another advantage of this is that it is not necessary to make up stocks of the foam material and when the method is concluded there is very little unused material lost.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

FIGS. 7A and B and FIGS. 8 and 9 are three variants of the method of operating the squeegee device according to the invention.

DESCRIPTION OF THE PREFERRED EMBODIMENTS

Figure 1:
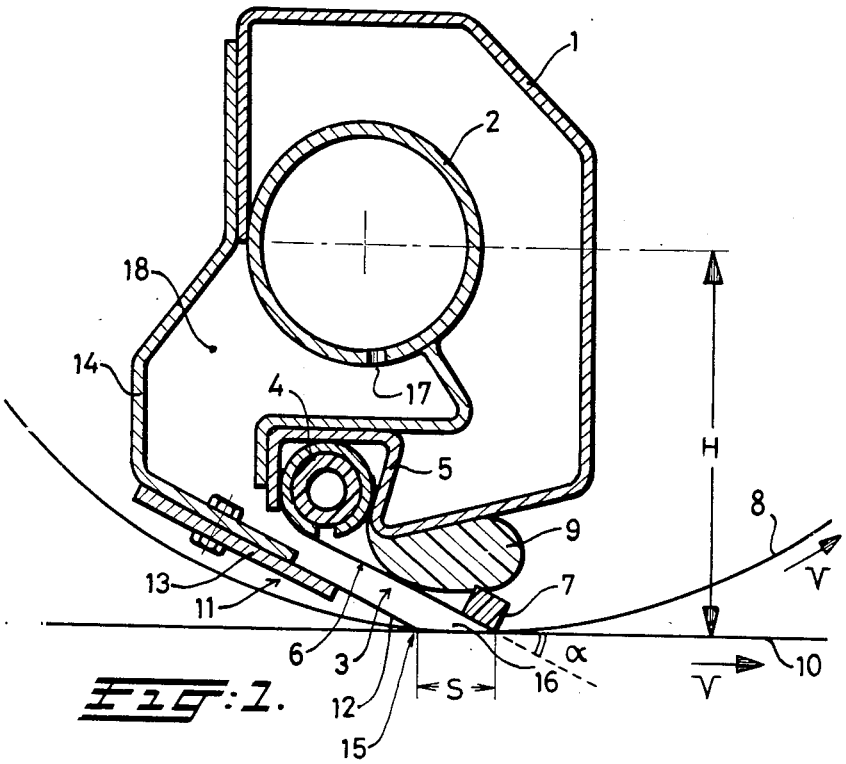
FIG. 1 is a cross-section of a first embodiment based on FIG. 10 of the aforementioned publication EU No. 0,011,314.

Referring now to FIG. 1, the squeegee device consists of a supporting structure 1 in the form of a box-shaped housing provided with a pipe 2 in the middle for the supply of the substance, e.g. an ink paste or a foam substance. Near the bottom, the supporting structure 1 is provided with a squeegee element 3 secured in a mounting 5 of the support structure by means of an inflatable clamping hose 4. The squeegee element 3 consists of a metal sheet 6, e.g. of spring steel, the free edge of which is provided with a prismatic plastic bar 7. In this figure bar 7 is of square section and rests by a rib against the inside of a cylindrical stencil 8. A bag 9 in the form of a hose is also clamped in the mounting 5 and is filled with a fluid, the pressure of which can be increased or reduced. Bag 9 forms a biasing member for the squeegee element 3 and rests against a part of the support structure 1 at the top and against the sheet 6 and bar 7 at the bottom. So far the device described is substantially the same as the aforementioned publication EU No. 0,011,314.

The stencil 8 is in contact with a substrate 10 consisting mainly of a web of textile or plastic. The squeegee element 3 includes an angle $\alpha$ with the substrate. A closure strip 11 is formed by a band 12, e.g. of spring strip steel and a metal part 13 disposed at some distance from the squeegee element. Part 13 is secured on an additional extension 14 of the housing-shaped support structure 1. The front edge 15 of the closure atrip 11, i.e. the metal band 12, is in contact with the stencil 8 in a zone which, as considered in the direction of advance V, is situated at some distance upstream of the squeegee element 3. A passage gap 16 is thus formed between the strip and those edges of the squeegee element which are in contact with the stencil 8.

Near its underside, the pipe 2 comprises a number of holes 17 for the passage of the viscous substance supplied inside the pipe 2. This supply is effected at some pressure so that the space 18 is filled with the substance. Space 18 is bounded by the pipe 2, the extension 14, the mounting 5, the squeegee element 3, the closure strip 11 and the stencil 8. The width of the gap 16 is indicated by S.

Figure 2:
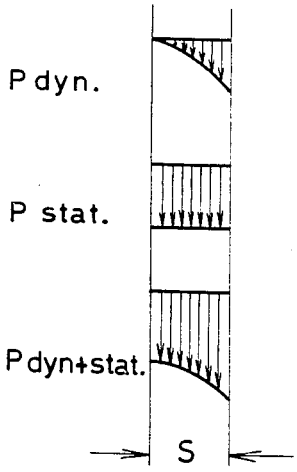
FIG. 2 is an approximate picture of the pressure occurring in the substance at the passage gap.

Referring now to FIG. 2 during the operation of the squeegee device, there is a certain pressure build-up in the viscous substance at the gap 16. This pressure build-up consists of a dynamic pressure component as a result of the wedge effect between the squeegee element 3 and the traveling stencil 8. This component of the pressure increases over the width S of the gap 16, see the top of the figure. As a result of the fact that the substance is supplied with some excess pressure via the pipe 2, there is a static pressure component denoted in the middle part of the figure. The total pressure is the sum thereof and is indicated in the bottom part of the figure. This pressure provides good sealing at the edge 15 of the metal band 12, while the biasing member 9 ensures that the bar 7 presses against the inside of the stencil 8 with the required force. The substance will now be pressed on to the substrate 10 through the perforations in the stencil 8.

Figure 3:
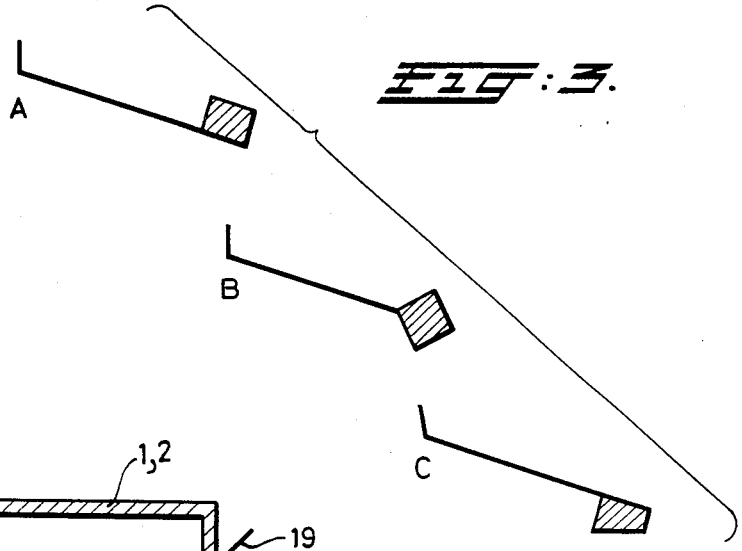
FIGS. 3A–C are three variants of the squeegee element according to the invention.

Referring now to FIGS. 3A–C three variants of the squeegee element 3, each consist of a sheet 6 and a prismatic bar 7. Variant A is substantially the same as the squeegee element shown in FIG. 1. Variant B allows a larger angle $\alpha$ despite the slight inclination of the sheet 6. Variant C prevents dynamic pressure from forming as a result of the side of the plastic prism situated perpendicularly to the stencil (no wedge angle). In this way application control is possible solely by the static pressure of the pump or a pressure vessel.

Figure 4:
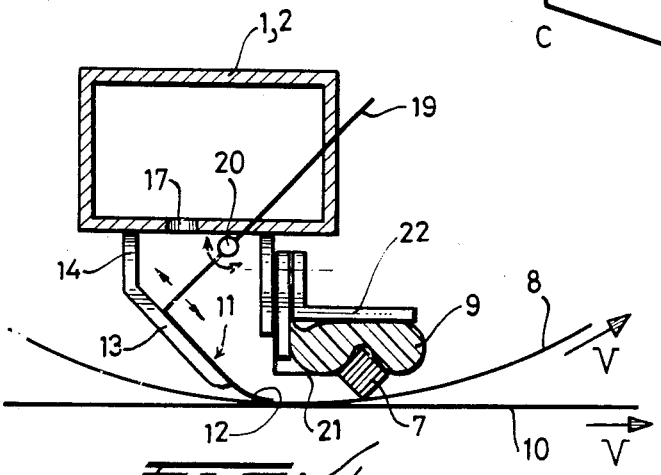
FIGS. 4 to 6 are three variants of the squeegee device according to the invention.

Referring now to FIG. 4 an embodiment is shown in which the closure strip 11 is mounted displaceably in the support structure 1. To this end, an actuating lever 19 having a pivot 20 is provided. at one or both ends of the support structure. The width S of the gap 16 can thus be adjusted.

Figure 5:
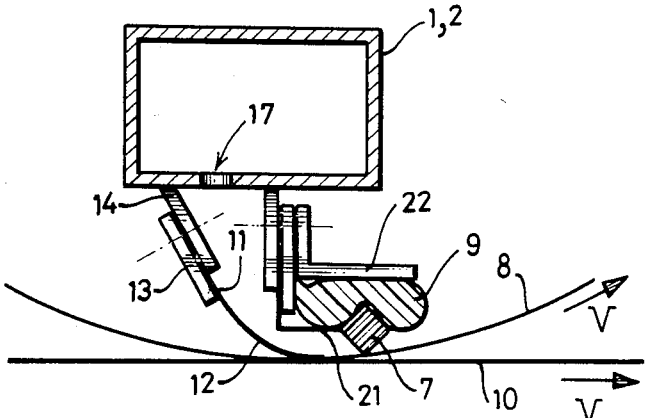

In the variant shown in the latter figure and in FIG. 5, the squeegee element 3 consists of a prismatic plasiic bar 7, which is preferably made from polyethylene. This bar is carried by an L-shaped gusset 21. In this way it is a simple matter to adjust the height of the bar 7 with respect to the support structure 1, and hence the position with respect to the closure strip 11. The biasing member 9 acts directly on the bar 7, said member bearing at the top against an angle section 22 provided for the purpose. FIG. 5 also shows an embodiment with a plastic band 12.

Figure 6:
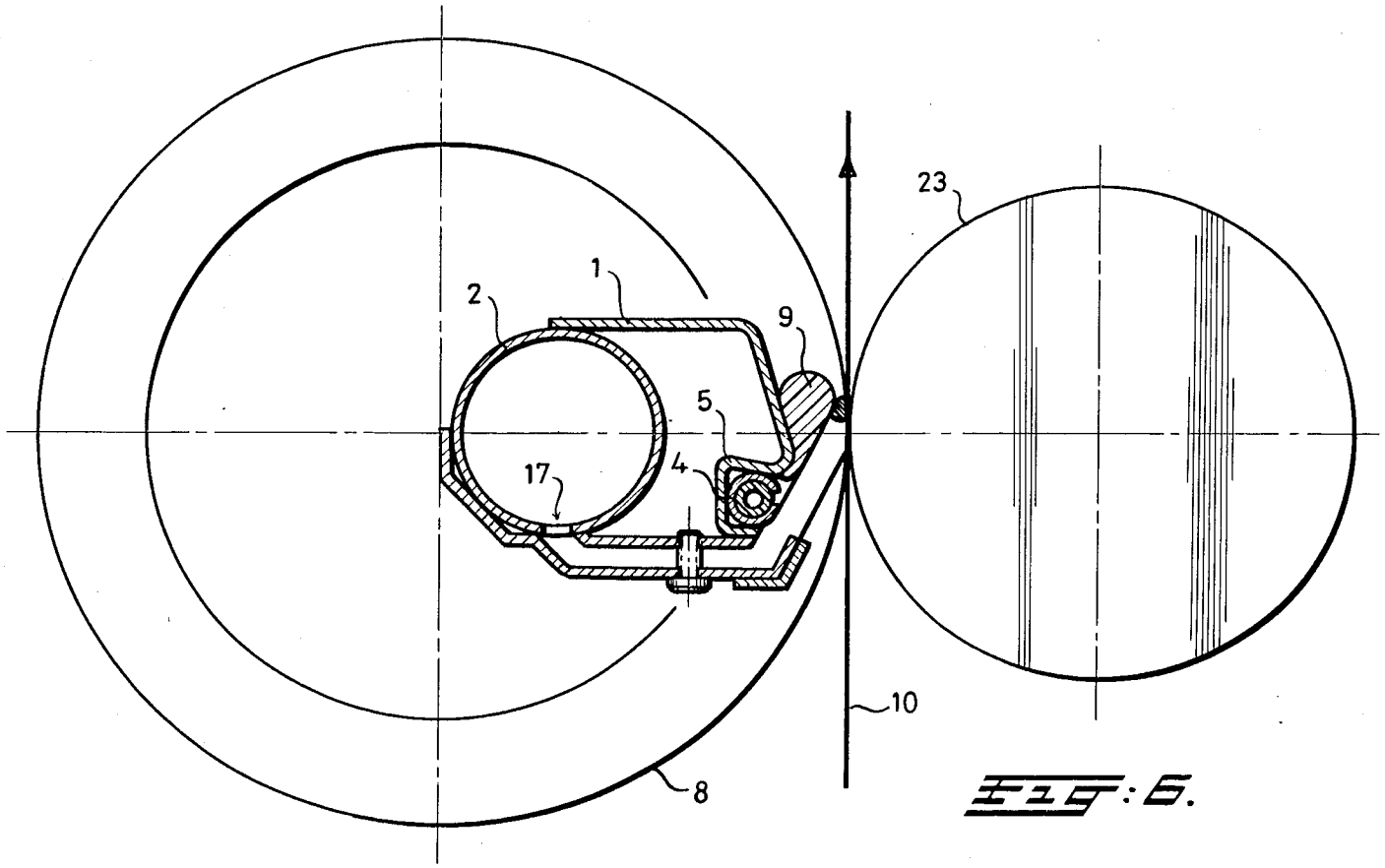

Referring now to FIG. 6 in a variant the substrate 10 moves vertically upwards instead of horizontally. Otherwise there are no basic differences from the variant of FIG. 1, except for structural details. Substrate 10 is supported at the gap 16 by a conventional roller 23.

Referring now to FIG. 7A a diagram shows the installation of the squeegee device in a stencil with the means for the pressurised supply of the viscous substance and for lateral sealing of the ends of the gap 16. The viscous substance is contained in a tank 24, said substance being fed to a vessel 26 by means of a pump 25. A (conventional) pressure control system 27 is provided on this vessel, while a level sensor 28 is provided to switch the motor 29 of pump 25 on and off. A hose 30 connects the interior of vessel 26 to the pipe 2 of the squeegee device. Pipe 2 is sealed at the left-hand end in the figure. The two ends of the space 18 are closed to prevent a pressure loss in the viscous substance. The two ends of the gap 16 are sealed off by means of plate-like elements 31 of cellular rubber, having a closed cellular structure.

Referring now to FIG. 7B a top plan view is shown of the device just described.

Referring now to FIG. 8 in an installation the motor 29 of the feed pump 25 for the viscous substance ia coupled via a controller 32 to a tachometer 33 of the substrate 10.

Referring now to FIG. 9 in an extension of the installation of FIG. 8, the viscous substance to be supplied consists of a material which is prepared in situ. To this end, the hose 30 coupled to the pipe 2 is connected to an emulsifier 34 driven by a motor 35. Connected to the emulsifier 34, on the one hand, is a conduit 36 by means of which the substance is supplied from the tank 24 and, on the other hand, a metered gas supply via the conduit 37. The latter also contains a flowmeter 38 and a control valve 39.

A number of printing tests were carried out with the squeegee device according to the present invention, using the following substances:

(a) normally used printing concentrations with pigment and reactive dispersed etc. dye systems in non-foamed form;

(b) formulations identical to coating formulations aa per e;

(c) mechanically foamed formulations with a binder system for pigments.

| Formulation: | |
|---|---|
| emulsifier w bayer | 10 gr |
| acrafix uc | 100 gr |
| acramin 3187 n | 200 gr |
| acramin clw | 100 gr |
| acraconc c | 15 gr (+10) |
| nekanil ln basf | 10 gr |
| pigment | 100 gr |
| water | 465 gr |
| | 1000 gr |

A number of coating tests were also carried out with the following substances:

(d) mechanically foamed ink formulations;

| example: ink formulations for reactive dye: | |
|---|---|
| cold water | 18950 gr |
| urea | 7500 gr |
| sodium bicarbonate | 1750 gr |
| ludigol | 750 gr |
| cibacron violet f 2 ra | 750 gr |
| nekalin ln | 300 gr |
| | 40000 gr |

(e) mechanically foamed acrylate dispersions and PVC plastisols;

EXAMPLE

Three methods can be used for the preparation of mechanically whipped PVC foam:

a. A formulation in which a PVC type is used which already contains a foam stabiliser, e.g. vestolit b 7022 made by Huels.

b. A formulation using a metal soap as a foam stabiliser.

c. A formulation in which a silicon product is used as foam stabiliser.

| | | |
|---|---|---|
| a. | vestolit b 7022 | 100 gr |
| | dioctylphthalate | 30 gr |
| | benzyl buryphthalate | 40 gr |
| | filler (e.g. calcium carbonate) | 50 gr |
| b. | vestolit 7021 | 100 gr |
| | santiciser 160 (plasticiser) | 40 gr |
| | dioctylphthalate | 25 gr |
| (+) | metal soap (k.l.o.p.) | 5 gr |
| | filler (e.g. calcium carbonate) | 50 gr |
| (+) | barium calcium zinc complex. | |
| c. | vestolit b 7021 | 100 gr |
| | dioctylphthalate | 30 gr |
| | benzyl butylphthalate | 40 gr |
| | filler (e.g. calcium carbonate) | 50 gr |
| | wacker foam stabiliser up 2242 | 3 gr |

-continued

| | |
|---|---|
| barium cadmium stabiliser | 2 gr |
| foam density about 500 g/liter | 100 gr |
| gelation temperature about 170° C. | |
| Rohm and Haas acrylate foam formulation | |
| primax 200 (acrylate dispersion) | |
| primax 110 | 7.5 gr |
| (foaming agent + stabiliser) | |
| titanium dioxide (50%) | 10 gr |
| foam density about 200 g/liter | |

(+) alternatively usable (f) mechanically foamed formulations used for applying various finishing products to textiles;

The following substances were used:

1. Crease removal for, e.g., 100% cotton, PE cotton and other natural fibers or mixtures of synthetic and natural fibers.

| | |
|---|---|
| a. synthetic resin | 200–400 gr/l |
| b. catalyst | 50–150 gr/l |
| c. plasticiser(s) | 60–120 gr/l |
| d. foaming agent | 5–10 gr/l |
| e. additives | 0–10 l |

a. Synthetic resin p A distinction is made here between the self-reticulating types and the reactant types. The latter react with the hydroxyl groups of the fiber only under the influence of a catalyst e.g.

1. Self-reticulating types: dimethylol urea

2. Reactant types: dimethylol-dihydroxy-ethylene-urea (most frequently used).

Some commercial names:

a-1. kaurit's basf a-2.

fixpret cpn basf sancowad k resin 7901 sandoz knittex gm conc ciba-geigy.

b. Catalyst

The catalysts most used are metal salts, e.g. zinc nitrate, zinc chloride and magnesium chloride. Ammonium salts are used particularly for cellulose-containing substrates e.g.

ammonium nitrate ammonium chloride ammonium sulphate.

Complex catalysts are used mainly in the sdc process (=shock drying condensation process) e.g. condensol sk basf.

c. Plasticiser(s)

The standard plasticisers used in finishing can also be used here.

The only restriction is that the plasticiser must not give the resulting foam excessive stability. Silicon-based plasticisers (particularly in high concentrations) may act as anti-foaming agents.

The following can be used for example:

sancowad k 7906 sandoz sancowad k 7911 sandoz basosoft on basf avivan splciba geigy avivan ra ciba geigy d. Foaming agent Nonyl phenols containing 5–10 mol ethylene oxide or sulphonates of higher alcohols are used for example e.g.

nekanil ln basf laviron waz (spec) henkel sancowad an sandoz sancowad n 1 sandoz
irgapadol 4232 ciba geigy.
e. Additives Some of the most important are the following for example:

1. Chemicals for improving tearing strength e.g.
   perapret hvn basf
   siligene base
2. Chemicals to allow making (working) up in the clothing industry. These are generally: Polyethylene dispersions e.g.
   perapret pe 40 basf
   sancowad k7903 sandoz
3. Foam stabilisers or laminate stabilisers synthetic thickeners (e.g. hydroxyethyl cellulose) Used:
   natrosol 250 hhr
   tylose h 4000
   irgapadol 4187
   komperlan kd
4. Optical brighteners e.g.
   blankopher bru bayer
   uvitex 2 bt-130% ciba-geigy
   uvitex ernp 250% ciba-geigy
   leukophor bcr sandoz
   leukophor ehb sandoz 2. Waterproofing In principle it is possible to use formulation 1. The choice of synthetic resin catalyst and the like is adjusted according to the waterproofing agent.

Synthetic resin: knittex fa conc. ciba geigy

Waterproofing agent:
phoboton ws conc ciba geigy
phoboton bc ciba geigy

During the test program using the above tests it was found that the new squeegee device can generate an optimum and uniform dynamic pressure at the gap 16. It was also found that with many substances most of the application control can be achieved by simply the static pressure in the substance. It is then possible to use a squeegee element according to FIGS. 3B, 4 and 5. The facility shown in FIG. 4 for controlling the width S of the gap 16 can also be used as a factor for the application control of the substance.

The tests carried out with substances consisting of the normal printing pastes show the great flexibility in respect of application control. The supply of the printing paste to the squeegee is carried out as shown in FIGS. 7 and 8. The controller 32 used in FIG. 8 enables adjustment of the required volume of substance per linear metre of substrate.

The tests using foamed substances also gave good results. For working up foam it is desirable to keep the time between the foam production and application as short as possible. This is all the more important the lower the stabilisation of the foam. The phenomena occurring in such conditions are a change of foam structure and moisture secretion. The result will then be uneven foam production. In the installation of FIG. 9, the emulsifier or foam mixer 34 is coupled on-line to pipe 2 and the foam residence time is restricted to a minimum. The contents of the squeegse system are also kept to a minimum. In this way it is possible successfully to use very unstable foam systems.

As a result of the construction of the squeegee device, the foam does not come into contact with the shearing forces of the advancing stencil 8 until it reaches the gap 16. This is very important to keep the foam quality as constant as possible. It has also been found that the stencil, which forms a perforate partition between the substance and the substrate, ensures that the application becomes virtually independent of the hydrophilic properties of the substrate.

The use of special fine-mesh rotation stencils 8 having a large passage percentage gives virtually no loading on the foam.

It should be noted that in a squeegee system as described, for example, in the publication EU No. 0,011,314 the use of foam entails a residence time under difficult shearing conditions, the residence time being so long and uncontrolled that it is impossible to achieve a good printing result unless extremely stable foam substances are used. However, these give rise to problems elsewhere in the process because such foam materials are difficult to destroy and therefore are not absorbed sufficiently quickly by the substrate.

When viscous substances in the form of foam materials are used, it is desirable for the foam production to proceed continuously without any interruptions therefore. Under those conditions it is impossible to obtain an on/off control using level sensors. The installation of FIG. 7 is therefore suitable only for normal printing pastes. The variant shown in FIG. 8 illustrates an installation which ensures uninterrupted coupling to the advancing substrate. This control can be extended as shown in FIG. 9, in which the amount of gas supplied, i.e. the so-called blow ratio, is kept constant. For very accurate control, flow measurement should also be carried out on both the gas and the substance via the elements 38.

What is claimed is:

1. A squeegee device for pressing a foamed substance through the perforations in a movable stencil onto an advancing substrate comprising:

(a) a flexible blade element;
(b) a support structure for the blade element;
(c) a biasing member for holding the blade element in pressure contact with the stencil, said blade element being inclined rearwardly for contacting said stencil, said biasing member being controllable for varying the contact pressure of said blade element with the stencil;
(d) a closure strip disposed on said support structure forward of and spaced from said blade element, said closure strip being inclined rearwardly toward the blade element and having a front edge thereof in pressure contact with the stencil, forming thereby a passage gap between the front edge of said closure strip and an edge of the blade element contacting said stencil;
(e) said closure strip being displaceably mounted in said support structure whereby the width of said passage gap is adjustable; and
(f) elastically deformable means for laterally sealing the ends of the passage gap.

2. The squeegee device of claim 1 wherein the blade element comprises a prismatic plastic bar which is subject to the direct action of the biasing member, the leading side of said bar being disposed substantially perpendicular to the inner side of the stencil.

3. The squeegee device of claim 1 wherein the sealing means for the ends of the gap consist of cellular rubber elements having a closed cellular structure.

* * * * *